US008616942B2

(12) United States Patent
Stump et al.

(10) Patent No.: US 8,616,942 B2
(45) Date of Patent: Dec. 31, 2013

(54) MODULAR BULK COIN DISPENSER WITH HOPPER REMOVAL FROM DRIVE AND CONTROL MECHANISM

(75) Inventors: Paul O. Stump, Topsfield, MA (US); Jeffrey M. Janway, Manchester, NH (US); Michael Thibedeau, Londonderry, NH (US); Victor A. Quattrini, Merrimac, MA (US)

(73) Assignee: Telequip Corporation, Salem, NH (US)

( * ) Notice: Subject to any disclaimer, the term of this patent is extended or adjusted under 35 U.S.C. 154(b) by 131 days.

(21) Appl. No.: 13/092,814

(22) Filed: Apr. 22, 2011

(65) Prior Publication Data

US 2011/0263190 A1 Oct. 27, 2011

Related U.S. Application Data

(60) Provisional application No. 61/326,963, filed on Apr. 22, 2010.

(51) Int. Cl.
*G07D 1/00* (2006.01)

(52) U.S. Cl.
USPC ..... 453/49

(58) Field of Classification Search
USPC ..... 453/3, 29, 30, 32–335, 18, 19; 221/241, 221/304, 307–310; 194/293–296, 298–300
See application file for complete search history.

(56) References Cited

U.S. PATENT DOCUMENTS

| | | | | |
|---|---|---|---|---|
| 5,531,640 | A * | 7/1996 | Inoue | 453/17 |
| 5,711,704 | A * | 1/1998 | Hughes et al. | 453/57 |
| 6,328,149 | B1 * | 12/2001 | Blad et al. | 194/217 |
| 7,186,176 | B2 * | 3/2007 | Umeda | 453/29 |
| 7,270,599 | B2 * | 9/2007 | Hu et al. | 453/18 |
| 2002/0123303 | A1 * | 9/2002 | Spoehr et al. | 453/3 |
| 2003/0148729 | A1 | 8/2003 | Abe et al. | |
| 2008/0220708 | A1 | 9/2008 | Maki | |

OTHER PUBLICATIONS

International Search Report dated Jan. 9, 2013 in connection with International Patent Application No. PCT/US2011/33624, 3 pages.
Written Opinion of International Searching Authority dated Jan. 9, 2013 in connection with International Patent Application No. PCT/US2011/33624, 5 pages.

* cited by examiner

*Primary Examiner* — Mark Beauchaine

(57) ABSTRACT

A bulk coin dispenser bin holds nonaligned coin inventory even when removed from a base containing drive mechanisms and control electronics. A rotor assembly at the bin outlet retains coin inventory during separation, with a rotating disk dispensing coins through a discharge slot in a controlled manner. Optional adjustment of the rotor assembly's angular positioning changes the coin size/denomination dispensed by the bin. Uniqueness required to dispense coins of a given size/denomination is embodied in the bin, such that any base may operate with the bin without adjustment other than update of bin denomination in the dispensing system controller. Bin location and the combination of coin denominations dispensed may thus be readily altered within the dispensing system. Optional bin memory and optical level sensing improve inventory management functionality.

20 Claims, 5 Drawing Sheets

MODULAR BULK COIN DISPENSER WITH HOPPER REMOVAL FROM DRIVE AND CONTROL MECHANISM

CROSS-REFERENCE TO RELATED APPLICATIONS

This application claims priority to U.S. Provisional Patent Application Ser. No. 61/326,963 entitled MODULAR BULK COIN DISPENSER WITH HOPPER REMOVAL FROM DRIVE AND CONTROL MECHANISM and filed on Apr. 22, 2010. The content of the above-identified patent document is incorporated herein by reference.

TECHNICAL FIELD

The present application relates generally to bulk coin handling mechanisms and, more specifically, to a modular bulk coin dispenser with a removable bin that retains inventory when removed from the base.

BACKGROUND

"Bulk" coin dispensers use a bin or "hopper" for storing coins (including tokens or other disk-shaped objects) in random orientation rather than stacked or otherwise aligned in canisters or tubes. Use of such a bin makes loading inventory much simpler than for devices requiring alignment of the coins, and also facilitates use of the dispenser as a coin recycler by allowing coins to be collected in random orientation rather than in stacked, aligned orientation.

Generally the bin storing inventory for a bulk coin dispenser is integral to and inseparable from the remainder of the dispensing drive system. Thus removal of coin inventory often requires removal of the entire dispenser, including the base containing the control electronics and drive mechanisms, or at least tilting of the entire dispenser to empty the bin into another receptacle. Such removal or other movement of the entire dispenser increases the opportunity for damage to mechanical components and/or electrical interfaces, and transfer of coins may result in loss or theft. In addition, storage of entire dispensers with coin inventory within a safe limits the amount of inventory that can be stored in a given volume. In designs where the bin is removable from the dispenser base, as shown in U.S. Pat. No. 7,572,177, the opening at the bottom of the bin for receiving the rotatable disk with cutouts employed to dispense coins precludes the removal of the bin while still holding coin inventory.

There is, therefore, a need in the art for an improved bulk coin dispenser.

SUMMARY

A bulk coin dispenser bin holds nonaligned coin inventory even when removed from a base containing drive mechanisms and control electronics. A rotor assembly at the bin outlet retains coin inventory during separation, with a rotating disk dispensing coins through a discharge slot in a controlled manner. Optional adjustment of the rotor assembly's angular positioning changes the coin size/denomination dispensed by the bin. Uniqueness required to dispense coins of a given size/denomination is embodied in the bin, such that any base may operate with the bin without adjustment other than update of bin denomination in the dispensing system controller. Bin location and the combination of coin denominations dispensed may thus be readily altered within the dispensing system. Optional bin memory and optical level sensing improve inventory management functionality.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 4, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged vending machine currency handling system.

Figure 1:
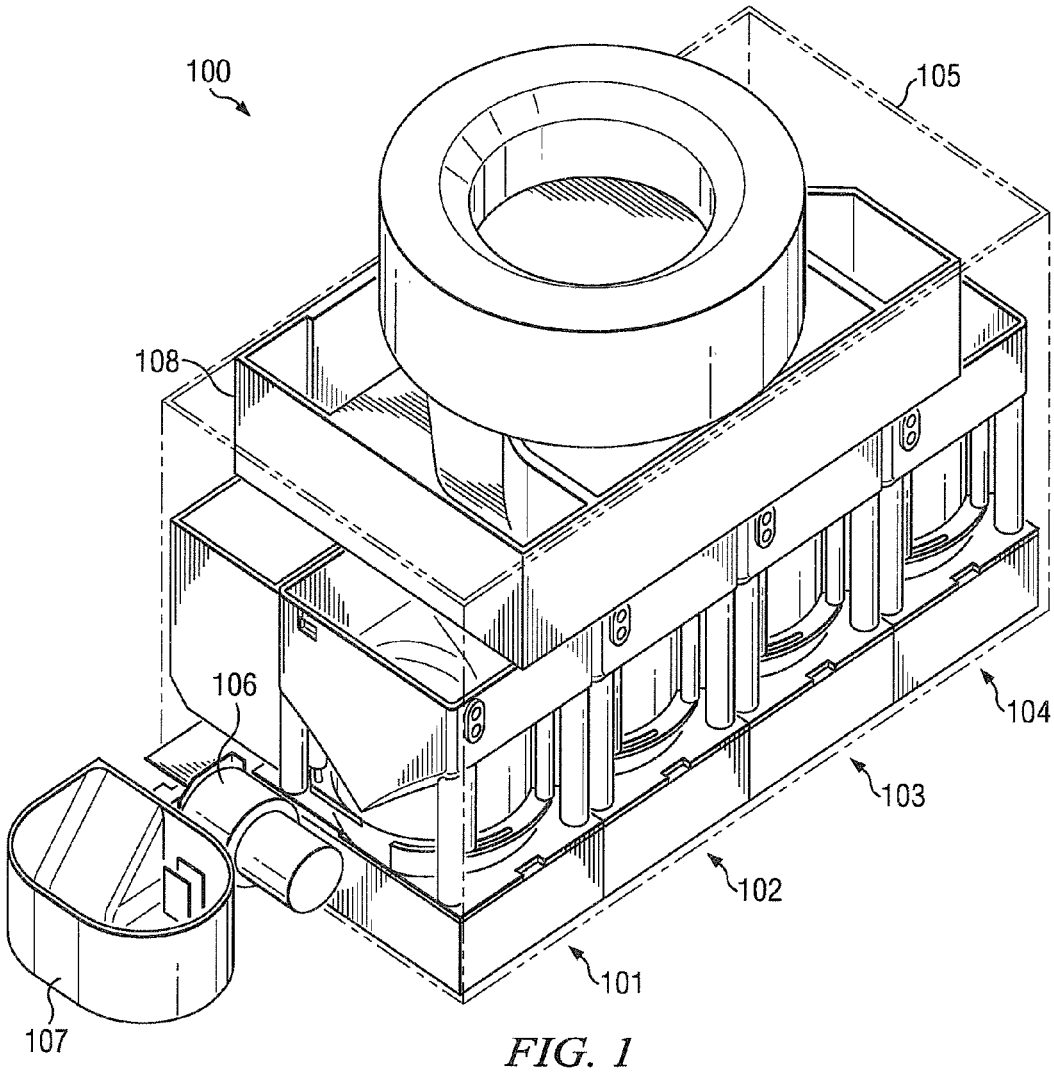
FIG. 1 depicts a modular bulk coin dispenser system in which the coin dispensers each include a bin removable from the drive and control mechanisms according to one embodiment of the present disclosure.

FIG. 1 depicts a modular bulk coin dispenser system in which the coin dispensers each include a bin removable from the drive and control mechanisms according to one embodiment of the present disclosure. Dispenser system 100 may be employed as part of a change-making machine for dispensing coins in exchange for paper currency or credit, as a change machine connected to a cash register or teller terminal in a retail establishment, restaurant or bank, or in a kiosk or other self-service vending system. Alternatively, dispenser system 100 may be employed in a gaming machine or in a vending machine.

Those skilled in the art will recognize that some aspects of dispenser system 100 are not visible in the drawings and that the full construction and operation of dispenser system 100 is not described herein. Instead, for simplicity and clarity, only so much of dispenser system 100 as is unique to the present disclosure and/or necessary for an understanding of the present disclosure is depicted and described.

Dispenser system 100 includes and holds coins within multiple bulk coin dispensers 101-104. Bulk coin dispensers 101-104 may be manually stocked with coins to be dispensed as change or for use in currency exchange (e.g., notes for coins), or alternatively receive coins from a coin validation subsystem (not shown). Dispenser system 100 has four inline bulk coin dispensers in the exemplary embodiment, but may alternatively have more or fewer bulk coin dispensers (e.g., three or six) and/or may have the bulk coin dispensers oriented face-to-face. Bulk coin dispensers 101-104 are held in aligned position by an outer casing 105, which supports the bottom of each bulk coin dispenser 101-104. Each of the bulk coin dispensers 101-104 within dispenser system 100 feeds coins into a common coin dispensing channel 106 leading to a coin cup 107. In the exemplary embodiment depicted, a coin separator 108 is mounted within the outer casing 105 above the bulk coin dispensers 101-104 for separating received coins by size/denomination so that dispenser system 100 operates as a coin recycler.

Figure 2:
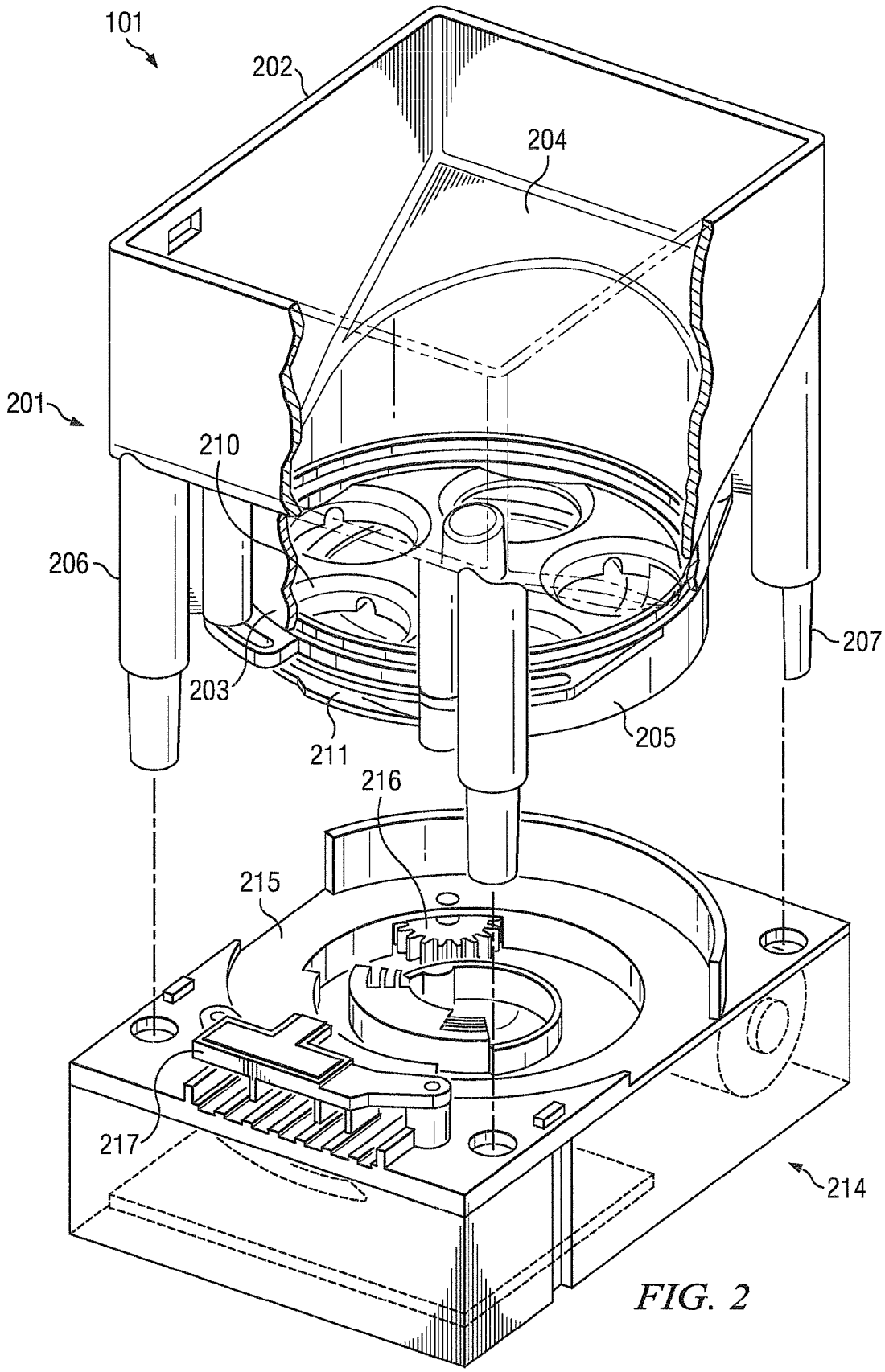
FIG. 2 depicts a bulk coin dispenser with a bin removable from the drive and control mechanisms according to one embodiment of the present disclosure.

FIG. 2 depicts a bulk coin dispenser with a bin removable from the drive and control mechanisms according to one embodiment of the present disclosure. Bulk coin dispenser 101 is illustrated in FIG. 2, but coin dispensers 102-104 in FIG. 1 are substantially identical except for differences to accommodate different coin sizes/denominations as described below. The component structural portions removable bin 201 and base 214 of the bulk coin dispenser 101 depicted and described herein may be formed from plastic as known in the art.

Bulk coin dispenser 101 has a removable bin 201. An upper portion of removable bin 201 has sidewalls 202 defining a rectangular cross-section therein and a lower portion formed by a cylinder 203 terminating in a circular opening, with sloped surfaces 204 in between the upper and lower portions guiding coins therein toward the circular opening at the bottom of bin 201.

Figure 2A:
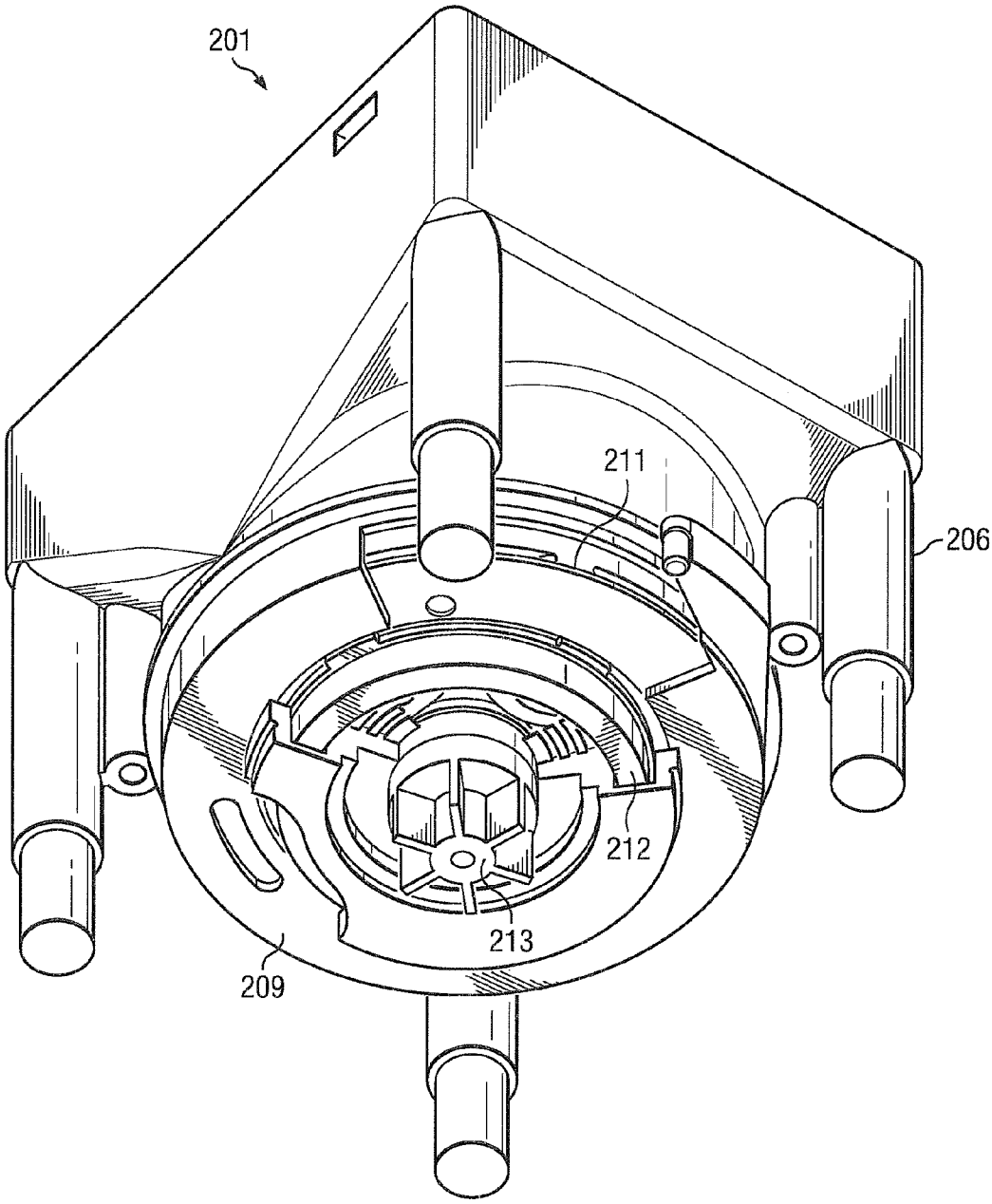
FIG. 2A is a bottom perspective view of removable bin for a bulk coin dispenser according to one embodiment of the present disclosure.

A cylindrical post 206 extends downwardly from each corner of the upper portion 202, terminating in a projection 207 that is received by a hole within the base, to contribute to support of the bin 201 when the bin is mounted on the base. The projections 207 may be cylindrical as shown in FIG. 2A or tapered half-cylinders as shown in FIG. 2. However, the shape of the projections or "legs" is not critical and may be, for example, a flat blade. In fact, the support structure need not be four legs as shown, but instead may be a sidewall structure around the perimeter of the removable bin 201.

Coins are held within removable bin 201 in basically random orientation (i.e., not in stacked alignment), and are urged by gravity toward the center circular opening at the bottom of the lower portion 203 of bin 201. A rotor assembly 205 is mounted within or over the circular opening at the bottom of the lower portion 203. The rotor assembly 205 is fixedly or removably attached to removable bin 201. That is, the rotor assembly 205 may be permanently affixed to the remainder of removable bin 201, or may be secured to the remainder of removable bin 201 in a manner that permits removal and replacement of the rotor assembly 205 (e.g., by screwing on counterpart threads, by rotational or lateral movement to engage latching structures or catches, by screws, or by various other means known in the art). However, during normal operation rotor assembly 205 is secured to the remainder of removable bin 201 and is removed from the base together with the remainder of removable bin 201 (when the bin is removed from the base), as shown by the bottom perspective view of the removable bin in FIG. 2A. Rotor assembly 205 thus covers the opening at the bottom of removable bin 201 and retains any coin inventory within the removable bin 201 when the bin 201 is removed from the base.

The rotor assembly 205, shown in partial cut-away from a bottom perspective in FIG. 2A, includes a rotatable disk constructed with multiple openings or cutouts sized for a specific coin denomination, and a support ring or plate immediately below the cutouts to retain the coins as they move in annular path. Such structures and their operation are generally known to those in the art, except rotor assembly 205 is affix or secured to the removable bin 201 for removal with the bin rather than forming part of base on which removable bin 201 rests during operation of the bulk coin dispenser 101. Rotor assembly 205 includes portions that may be rotated on the bin 201, as described in further detail below.

Rotor assembly 205 is formed by a housing 209 containing a rotatable disk 210 and including a slot 211 along a circumferential edge thereof through which coins are dispensed. As shown in FIG. 2, the disk 210 has multiple openings or cutouts receiving coins and sloped surfaces around the openings urging coins by gravity into the cutouts. The disk 210 has a thickness selected based on a thickest of the coins intended to be dispensed by bin 201. As illustrated in FIG. 2A, a support structure 212 (a ring in the exemplary embodiment) below the cutouts retains the coins within the cutouts. The disk 210 is mounted to a shaft extending through the rotor assembly housing 209 and connected to a gear wheel 213. Rotation of the gear wheel 213 causes rotation of disk 210, which rotation causes one or more coin(s) to be moved from the interior of the bin 201 through the slot 211 in the manner described in the patents identified above. Guide elements and an exit roller are positioned to urge coins within the cutouts to exit the disk 210 through the slot 211 as the disk rotates coins in those cutouts along an annular path past the guide elements and exit roller. The guide elements and exit roller may be adjustable to allow the bin 201 to operate with coins of different sizes (denominations). The coin(s) passing through slot 211 are thereby dispensed by bulk coin dispenser 101 into coin dispensing channel 106 and ultimately to coin cup 107.

The bin 201 is received by a base 214 containing the drive mechanism and control electronics of the general type known in the art, except for changes to the drive structure that allow the rotor assembly 205 to be removed from the base 214 with the removable bin 201. The base 214 includes a recess 215 receiving a portion of the rotor assembly 205 when the bin 201 is mounted upon the base, by simply setting the bin on top of the base 213. A drive gear 216 cooperates with gear wheel 213 on the bottom of the rotor assembly 205, and effects rotation of disk 210 when driven by a motor (not shown) within the base 214. Rotation of disk 210 by the drive mechanism, under control of control electronics within the base 214, is initiated in response to receipt of a signal by the bulk coin dispenser 101 (or by the dispenser system 100 generally, then routed by dispenser system 100 to bulk coin dispenser 101) to dispense one or more coins of a denomination of the coins held within the bin 201.

A guidance structure 217 aligns with the coin dispensing slot 211 in the rotor assembly 205 and includes an exit sensor. The guidance structure 217 both senses and guides coins passing through slot 211 into the coin dispensing channel 106. Rotation of disk 210 is terminated by the control electronics within base 214 once a specified number of coins are sensed passing through guidance structure 217. Signals indicating successful dispensation of the selected number of coins may then be returned by the control electronics within base 214, either to the dispenser system 100 or directly to a source of a command to dispense such coins.

Figure 3A:
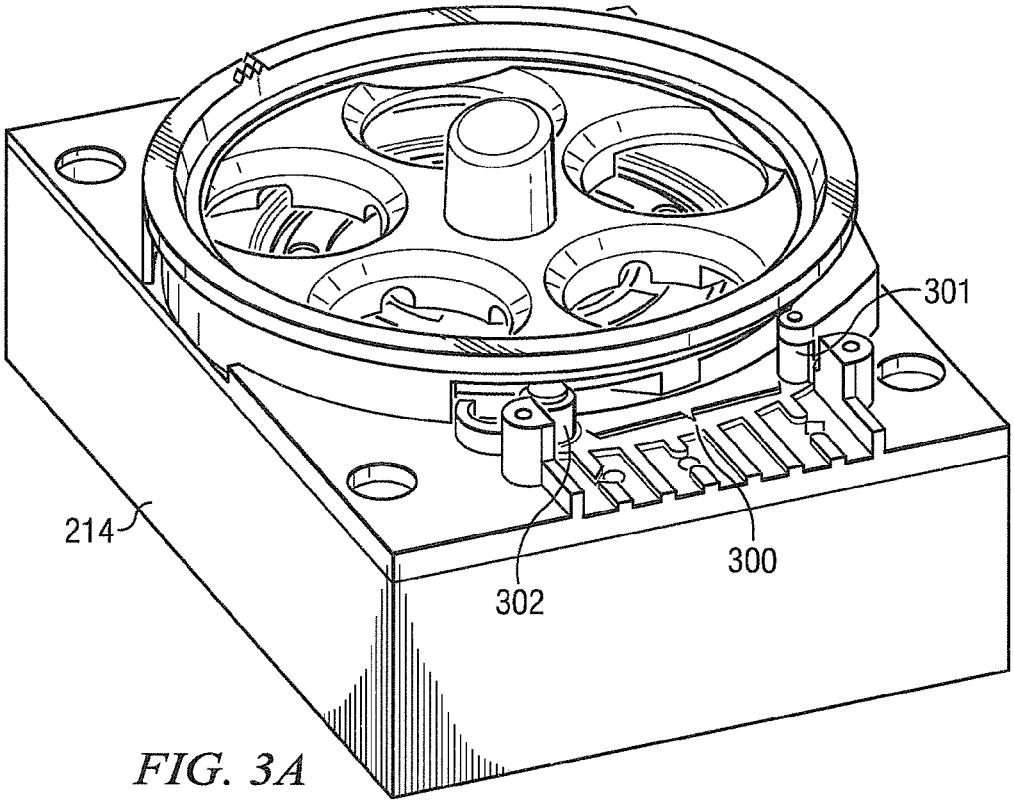
FIGS. 3A and 3B each depict selected portions of the base and the rotor assembly for a bulk coin dispenser with a bin removable from the drive and control mechanisms according to one embodiment of the present disclosure.
Figure 3B:
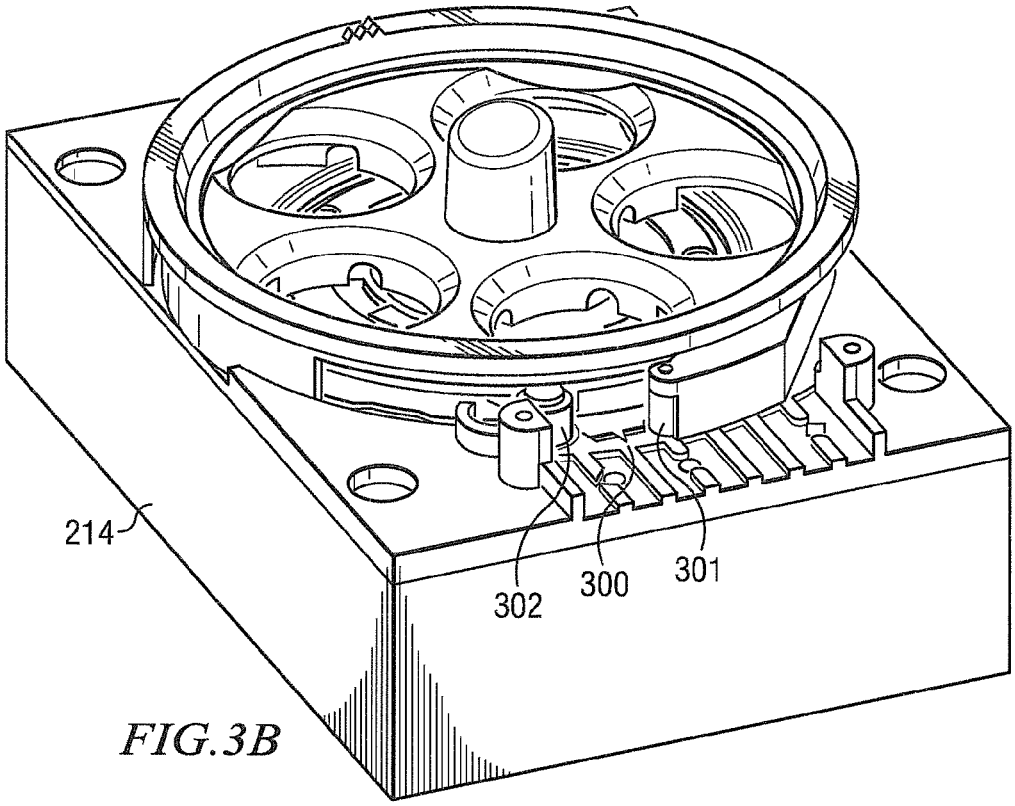

FIGS. 3A and 3B each depict selected portions of the base and the rotor assembly for a bulk coin dispenser with a bin removable from the drive and control mechanisms according to one embodiment of the present disclosure. In the views illustrated in FIGS. 3A and 3B, a portion of the rotor assembly 205 has been removed from the bin 201 and placed on base 214, and the cover of guidance structure 217 has been removed, to more clearly illustrate features of the present disclosure. As described above, at least some portions of rotor assembly 205 may be angularly rotated on the bin 201. Such angular rotation of portions of the rotor assembly relative to the base 214 allows the bin 201 to dispense coins of different denominations (sizes), as described in the patents identified above. Base 214 is configured to receive and operate with the rotor assembly 205 with regard to the position of the movable portions of rotor assembly 205 through the range of permitted angular rotation. FIGS. 3A and 3B illustrate the rotor assembly being received by the base with the movable portions or rotor assembly 205 adjusted for the bin 201 to dispense coins of a largest diameter (FIG. 3A) and of a smallest diameter (FIG. 3B).

Existing hopper designs typically require that components be replaced or repositioned to reconfigure the hopper to dispense coins of various sizes. For instance, if a hopper is initially configured to dispense United States dimes but is then required to dispense United States quarters, typically the rotor and some other component must be swapped or adjusted. Normally a dispensing system 100 consists of multiple hoppers or bins with at least some bins dispensing coins of different sizes/denominations (e.g., one bin dispensing Unites States dimes, one dispensing United States nickels, and two bins dispensing United States quarters). So, for example, a dispensing system for use with United States coins often contains up to or in excess of four unique hoppers, with each bin configured for one of the denominations of commonly-used United States coins (penny, nickel, dime and quarter). Since each hopper is configured for a specific denomination, the hoppers are arranged in a specific layout that cannot be changed without a high degree of difficulty, resulting in a dispensing system that is not flexible since the number and location of hoppers dedicated to each denomination cannot be easily changed.

Because bulk coin dispensing hoppers are typically configured to handle a specific coin, the hopper is usually connected to a control/electrical system in a way that prevents easy relocation of a coin denomination within a dispensing system, or reconfiguration of the dispensing system to handle different permutations of coin denominations. Reconfiguration of the coin inventory may be desirable as products and pricing change.

The bulk coin dispenser 101, and the coin dispensing system 100 including bulk coin dispenser 101, allows coin inventory contained in the bin 201 to be separated from the base 214 containing the control electronics and drive mechanisms. A bottom surface in the bin 201, provided by rotor assembly 205, retains coins inside the bin even when the bin is lifted away from the base. With previous designs, the base was integral to the bin or, where a removable bin was provided, acted as the bottom of the bin, such that the bin could not be removed from the base with coin inventory therein. In addition, bin 201 is attached to the base in a manner allowing capture of the bin by the base 214 when placed on the base, and allowing for easy removal of the bin 210 when lifted from the base. The bin, when placed on the base in the manner intended, is inherently accurately aligned to the base such that the bin's angular position is constant/repeatable whenever attached.

In some embodiments, the rotor assembly 205 may be affixed to the bin 201 in a non-movable manner, such that the coin size/denomination that may be dispensed by the bin may not be altered. However, the rotor assembly 205 is preferably attached to the bin 201 in a way that allows the rotor assembly to be attached, removed or adjusted. The rotor assembly 205 and other mechanisms are attached to the bottom of outer structure forming the bin 201, at the point to which coins within the bin are urged by gravity. The rotor assembly 205 can be attached to the bin outlet in a range of angular positions rotating around the longitudinal axis of the bin 201. A pin 301 serves to create one side (movable hard point) of the coin discharge slot 300 when the bin 201, with rotor assembly 205 in place, is mounted on the base 214. The width of the coin discharge slot 301 is settable by varying the angular position of the rotor assembly 205 on the bin 201 before the bin 201 is mounted on the base 214. Pin 301 can be moved by angular rotation of the rotor assembly 205 on the bin 201, but does not move during discharge of a coin from the bulk coin dispenser 101. The opposite/fixed side of the coin discharge slot 301 is defined by the base 214 and is fixed angularly with respect to an axis perpendicular to the base and running through the longitudinal axis of the bin 201 when in the bin is in place on the base 214. The fixed side of the coin discharge slot 300 consists of a roller 302 that is spring loaded to allow for a slight degree of displacement as the coins depart the coin discharge slot 300. The spring-loaded roller 302 creates a slight squeezing against the edges of the coin when the coin travels through the coin discharge slot 300, imparting some energy to the coin and causing the coin to be ejected from the slot. Note that in FIGS. 3A and 3B the base 214 of the bulk coin dispenser 101 is depicted with portions of the rotor assembly 205 in place to illustrate the relationship of the pin 301, the roller 302, and the gap between those features forming coin discharge slot 300. The rotor assembly 205, including pin 301, are mounted to and form part of the bin 201, while the roller is mounted on the base 214.

The bin 201 with the rotor assembly 205 affixed thereto, the rotor assembly 205 being unique to a specific coin size/denomination, is captured on the base 214 with the rotor assembly 205 attached to the bin 201 at an angle that is also coin specific, such that the bin 201 takes on a configuration for the specific coin size/denomination. The bin 201 when placed on any instance of base 214 will dispense the coin specific to that bin configuration. When removed from the base 214, the bin 201 takes with it all uniqueness for the specific coin size/denomination, since as the base 214 is identical for all coin denominations. A base 214 may be employed to dispense any coin size/denomination simply by replacing the bin 201 with a different configuration or by removing the bin, altering the angular position of the rotor assembly 205, and replacing the bin on the base. This allows any bin 201 to be placed onto any base 214 and therefore into a coin dispenser system 100 at any location in the dispenser system. This feature also allows the combinations of denominations dispensed by a particular dispenser system 100 to be easily reconfigured, by simply replacing the bin 201 on the base 214 of selected bulk coin dispensers 101-104 and making minor software updates to the controller of dispenser system 100 to reflect the coin denominations in bulk coin dispensers 101-104. No changes to the base 214, including no reprogramming of the control electronics therein, is required.

Figure 4:
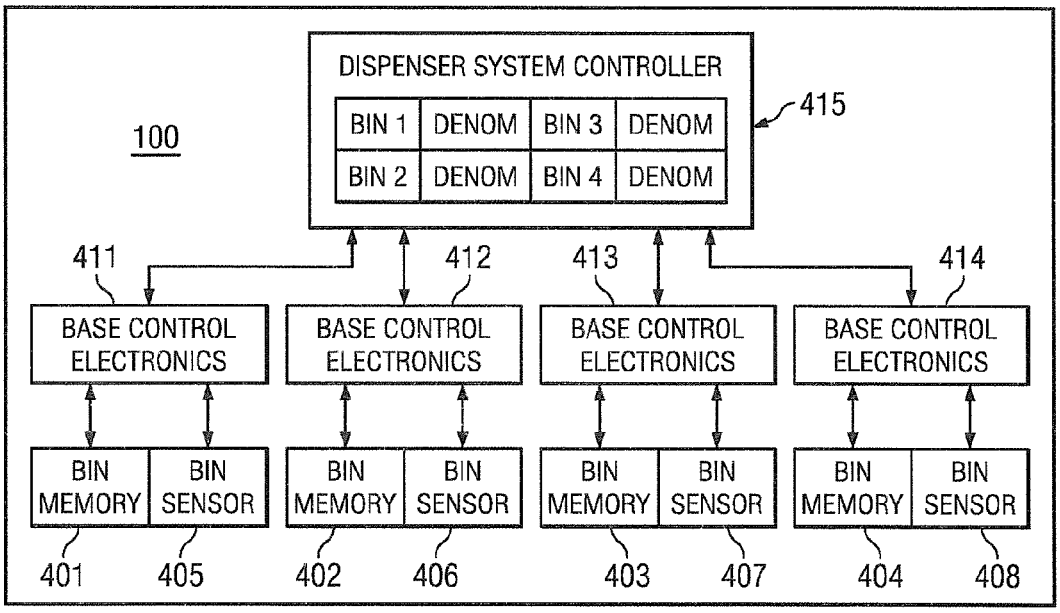
FIG. 4 is a high level block diagram of the control system for a modular bulk coin dispenser system in which the coin dispensers each include a bin removable from the drive and control mechanisms according to one embodiment of the present disclosure.

FIG. 4 is a high level block diagram of selected portions of the control system for a modular bulk coin dispenser system in which the coin dispensers each include a bin removable from the drive and control mechanisms according to one embodiment of the present disclosure. Each bulk coin dispenser 101-104 in dispenser system 100 includes an embedded bin memory 401-404 and an optical bin sensor 405-408 within the bin 201 of the respective bulk coin dispenser 101-104. Bin memory 401-404 and bin sensor 405-408 interface with the base control electronics 411-414 for the respective bulk coin dispenser 101-104 via electrical contacts (not visible in FIGS. 1-3B) between the bin 201 and the base 214. Those electrical contacts preferably do not pass through the rotor assembly. Bin memory 401-404 may be read and/or written to by dispenser system controller 415 via the electrical contacts to the respective base 214 and connections from the base 214 to controller 415. The location of the bin within the dispenser system 100 is thus apparent based on the base control electronics 411-414 through which the bin memory 401-404 is accessed. In some embodiments, each bin memory 401-404 may optionally be read and/or written to by the control electronics 411-414 for the respective base on which the bin is mounted, to update the contents of the corresponding memory 401-404 as coins are dispensed from that bin. Each embedded bin memory 401-404 may be, for example, an electrically erasable programmable read-only memory (EEPROM) or similar flash memory device, and is preferably mounted outside the bin in a position at which it can be easily replaced. For embodiments where angular position of the rotor assembly 205 at the outlet relative to the longitudinal axis of bin 201 may be changed, the contents of the corresponding bin memory should be updated whenever the rotor assembly position is altered.

Each memory device 401-404 on the bin 201 may store and communicate a unique bin identifier (i.e., serial number) and the configuration of the bin (i.e., the denomination of coins held within the bin, particularly where the rotor assembly 205 is fixed and cannot be changed for a specific bin). In addition, bin memory 401-404 may store and report additional data such as inventory level, history of use, history of insertion or removal from the dispenser system 100, location, etc. During a power-on self-test (POST) or similar startup procedure for the dispenser system 100, in response to an access panel to the bins within dispenser system 100 being unlocked and/or locked, or periodically during operation of the dispenser system 100, the dispenser system controller 415 may initiate a read of the contents of bin memories 401-404. The denomination of coins within each bin may thus be determined by controller 415 and stored in controller 415 for use in controlling operation of the bulk coin dispensers 101-104.

The availability of memory device 401-404 enables entirely new aspects to managing coin inventory, such as:

- bins can be placed on any base without concern for the location, and without manually reprogramming;
- the controller 415 can automatically determine the denomination of coins within each location within the coin dispensing system 100 and reconfigure itself to operate accordingly; and
- bins from one coin dispensing system 100 or cash handling location become interchangeable and may be placed in any other coin dispenser/cash handling location within a retail enterprise.

In addition, in conjunction with retailers, cash-in-transit companies (e.g., armored car services) can integrate the bin identity and data into a larger cash handling network. Such integration would permit total cash handling by the cash-in-transit companies, with the result being the removal of most or all of the cash handling activities by the retailer and corresponding reduction in cash handling costs and opportunities for theft by store personnel.

Most hopper devices also include a means for measuring the remaining coin inventory within the bin, to alert an operator when nearing an empty condition. For bulk coin dispenser systems that are also employed as a coin recycler, there may also be a high coin detection means. The method used to detect both high and low coin inventory is to detect electrical continuity through the coins, using electrodes placed inside the coin bin and attached to appropriate electrical circuitry. For high coin detection, the uppermost electrode is high in the bin and for low coin detection, the uppermost electrode is low in the bin, but in both cases the common electrode is also low in the bin. When coins bridge the gap between the highest electrode and the common electrode, an electrical current passing between those electrodes indicates that the coin inventory is in a high, full condition, while a break in electrical continuity between the lowest two electrodes indicates that the coin inventory is approaching an empty condition. This approach has inherent problems that limit the accuracy and repeatability.

Unlike products that use conductive low/high coin sensing techniques, bin sensors 405-408 employ an optical sensing means to provide more accurate/repeatable measurements. The bin sidewalls may be made of a transparent or translucent material, allowing electromagnetic radiation of at least a selected frequency (e.g., infra-red) to pass through the sidewalls. Alternatively holes in the bin sides, significantly smaller than the smallest coins dispensed, can be provided to allow for the passage of light beams through the bins (consequently removing the possibility of beam blockage by debris on the bin sidewalls). Optical emitter and detector pairs are attached to the base in the posts at the corners of the bin, and connect to the control electronics 411-414 for a respective base via electrical contacts (not shown in FIG. 2 or 3A-3B) at or near the ends of the posts. Multiple emitter/detector pairs can be placed in each post to give not only high and low coin detection, but also detection of intermediate levels, with the specific location of the emitter/detector pairs selected to optimize the coin level detection. The emitter/detector pairs remain with the base and therefore the possibility of damage is minimized.

The present disclosure describes and enables a bulk coin dispenser bin configured to hold unaligned coin inventory that is removable from a base containing the drive mechanisms and control electronics, without first emptying coin inventory from the bin. By affixing the rotor assembly to the bin at the outlet to which coins are urged by gravity, rather than including the rotor assembly as part of the base, the bin may be removed with the coin inventory still in the bin. Movement or storage of coin inventory thus requires only the bin, not the entire bulk coin dispenser. By including all uniqueness required to dispense coins of different sizes/denominations in the rotor assembly and/or bin, bin can be used with any base to dispense coins of the particular size/denomination, without modification of the base.

Although the present disclosure has been described with exemplary embodiments, various changes and modifications may be suggested to one skilled in the art. It is intended that the present disclosure encompass such changes and modifications as fall within the scope of the appended claims.

What is claimed is:

1. A bulk coin dispenser, comprising:

a base containing drive and control electronics; and a coin bin mounted on and removable from the base, the coin bin configured to hold nonaligned coins and urge the coins toward an outlet, the coin bin including a rotor assembly secured to the coin bin at the outlet and remaining secured to the coin bin when the coin bin is removed from the base, the rotor assembly configured to selectively pass coins from the coin bin through a coin discharge slot by rotation of a member within the rotor assembly, the coin discharge slot formed by a portion of the base and a portion of the rotor assembly, wherein a change of an angular position of the rotor assembly relative to the base changes a size of the coin discharge slot, and wherein the coin bin may be removed from the base while retaining coins therein.

2. The bulk coin dispenser of claim 1, wherein the member within the rotor assembly comprises a rotor having cutouts configured to accept coins from the coin bin and is configured to pass coins through the discharge slot by rotational movement of the rotor.

3. The bulk coin dispenser of claim 2, wherein the cutouts within the rotor are specific to a coin size of coins held within the coin bin.

4. The bulk coin dispenser of claim 3, wherein the base includes a movable element adjustable for operation of the base with a coin size specific to the rotor.

5. The bulk coin dispenser of claim 1, wherein the rotor assembly includes a drive gear configured to engage a drive mechanism on the base when the coin bin is mounted on the base.

6. The bulk coin dispenser of claim 1, wherein the control electronics are configured to selectively record a denomination of coins held within the coin bin when the coin bin is mounted on the base.

7. The bulk coin dispenser of claim 1, further comprising:

optical bin sensors mounted on the coin bin and configured to detect when a level of coins within the coin bin is below a position of the sensors.

8. The bulk coin dispenser of claim 7, wherein the optical bin sensors are mounted on a peripheral support structure for the coin bin and configured to operate through sidewalls of the coin bin that retains coins within the coin bin.

9. A modular bulk coin dispenser system comprising a plurality of the bulk coin dispensers of claim 1, wherein the rotor assemblies within two or more of the bulk coin dispensers are configured to operate with coins of different diameters.

10. A bulk coin dispenser, comprising:

a base containing drive and control electronics; and a coin bin mounted on and removable from the base, the coin bin configured to: hold nonaligned coins and urge the coins toward an outlet, the coin bin including a rotor assembly secured to the coin bin at the outlet and remaining secured to the coin bin when the coin bin is removed from the base, the rotor assembly configured to selectively pass coins from the coin bin through a coin discharge slot by rotation of a member within the rotor assembly, wherein the coin bin may be removed from the base while retaining coins therein, wherein the member within the rotor assembly comprises a rotor having cutouts configured to accept coins from the coin bin and is configured to pass coins through the discharge slot by rotational movement of the rotor, wherein the cutouts within the rotor are specific to a coin size of coins held within the coin bin, wherein the base includes a movable element adjustable for operation of the base with a coin size specific to the rotor, and wherein a portion of the base defines the coin discharge slot, and wherein the coin bin outlet is received by the base with an exit area for coins within the rotor cutouts aligned with portion of the base defining the discharge slot.

11. A method of operating a bulk coin dispenser, comprising:

mounting a coin bin on a base containing drive and control electronics in a removable fashion, the coin bin configured to hold nonaligned coins and urge the coins toward an outlet, the coin bin including a rotor assembly remaining secured to the coin bin when the coin bin is removed from the base; and rotating a member within the rotor assembly secured to the coin bin at the outlet to selectively pass coins from the coin bin through a coin discharge slot by rotation of the member, the coin discharge slot formed by a portion of the base and a portion of the rotor assembly, in response to changing an angular position of the rotor assembly relative to the base, changing a size of the coin discharge slot, and wherein the coin bin may be removed from the base while retaining coins therein.

12. The method of claim 11, wherein the member within the rotor assembly comprises a rotor having cutouts configured to accept coins from the coin bin and is configured to pass coins through the discharge slot by rotational movement of the rotor.

13. The method of claim 12, wherein the cutouts within the rotor are specific to a coin size of coins held within the coin bin.

14. The method of claim 13, further comprising:

adjusting a movable element within the base to adjust the base for operation with a coin size specific to the rotor.

15. The method of claim 11, further comprising:

causing a drive gear on the rotor assembly to engage a drive mechanism on the base when the coin bin is mounted on the base.

16. The method of claim 11, further comprising:

selectively recording a denomination of coins held within the coin bin within the control electronics when the coin bin is mounted on the base.

17. The method of claim 11, further comprising:

detecting when a level of coins within the coin bin is below a position of optical bin sensors mounted on the coin bin.

18. The method of claim 17, wherein the optical bin sensors are mounted on a peripheral support structure for the coin bin, the method further comprising:

detecting a level of coins within the coin bin through sidewalls of the coin bin that retains coins within the coin bin.

19. The method of claim 11, further comprising:

cooperatively operating two or more bulk coin dispensers, each having a rotor assembly configured to operate with coins of different diameters.

20. A method of operating a bulk coin dispenser, comprising:

mounting a coin bin on a base containing drive and control electronics in a removable fashion, the coin bin configured to hold nonaligned coins and urge the coins toward an outlet, the coin bin including a rotor assembly remaining secured to the coin bin when the coin bin is removed from the base;

rotating a member within the rotor assembly secured to the coin bin at the outlet to selectively pass coins from the coin bin through a coin discharge slot by rotation of the member, wherein the member within the rotor assembly comprises a rotor having cutouts configured to accept coins from the coin bin and is configured to pass coins through the discharge slot by rotational movement of the rotor, wherein the cutouts within the rotor are specific to a coin size of coins held within the coin bin; and adjusting a movable element within the base to adjust the base for operation with a coin size specific to the rotor, wherein the coin bin may be removed from the base while retaining coins therein, and wherein a portion of the base defines the coin discharge slot, and wherein the coin bin outlet is received by the base with an exit area for coins within the rotor cutouts aligned with portion of the base defining the discharge slot.

* * * * *